United States Patent [19]

Taylor

[11] 3,993,126

[45] Nov. 23, 1976

[54] HEAT EXCHANGER

[75] Inventor: Charles Taylor, Potters Bar, England

[73] Assignee: Delanair Limited, Barking Essex, England

[22] Filed: July 25, 1974

[21] Appl. No.: 491,648

[30] Foreign Application Priority Data

July 27, 1973 United Kingdom ..... 35877/73

[52] U.S. Cl. ..... 165/173; 29/157.4; 156/296; 156/330; 165/79; 165/180

[51] Int. Cl.[2] ..... F28F 9/04

[58] Field of Search ..... 165/180, 173, 178, 79; 29/157.4; 156/330 X, 296 X

[56] References Cited

UNITED STATES PATENTS

| | | | |
|---|---|---|---|
| 2,006,836 | 7/1935 | Lavender | 165/79 |
| 3,129,931 | 4/1964 | Stookey | 165/174 X |
| 3,326,279 | 6/1967 | Eisberg et al. | 165/173 |
| 3,447,603 | 6/1969 | Jones | 165/178 |
| 3,489,209 | 1/1970 | Johnson | 165/180 X |
| 3,633,660 | 1/1972 | Young | 165/173 X |
| 3,724,537 | 4/1973 | Johnson | 165/173 X |

FOREIGN PATENTS OR APPLICATIONS

| | | | |
|---|---|---|---|
| 1,188,981 | 4/1970 | United Kingdom | 29/157.4 |
| 731,431 | 6/1955 | United Kingdom | 165/173 |
| 724,017 | 2/1955 | United Kingdom | 165/173 |

*Primary Examiner*—Albert W. Davis, Jr.
*Assistant Examiner*—S. J. Richter
*Attorney, Agent, or Firm*—Wood, Herron & Evans

[57] ABSTRACT

A heat exchanger of the type having header tanks connected by a number of tubes of heat conductive material which extend between the tanks and which communicate with the tanks by passing through holes in a collector plate forming a wall of each header tank, wherein the collector plates of one or both tanks is formed of a resin compound separated from the interior of its tank by a membrane of a plastics material through which the tubes pass and which is sealed around the tubes, the resin collector plate being bonded to the tubes.

11 Claims, 6 Drawing Figures

8
20
4
28
22
2
16
6
12
14
30
11
24

8
38
40
24
28
20
22
2
14
6'
11
36

8
11
6
12'
14'
4'
35
2'
24
32
20'
34

HEAT EXCHANGER

This invention relates to heat exchangers of the type in which a number of tubes of heat conducting material extend from holes in a collector plate forming one wall of a header tank.

Traditional constructions involve brazing or welding the tubes in the collector plate holes in order to seal them and to withstand the fluid pressure. The construction is expensive and not suitable for aluminium which it is desirable to use for the tubes because of its good thermal conductivity and light weight.

In a heat exchanger of the invention the collector plate is formed from a resin compound (preferably epoxy resin) and is separated from the tank interior by a plastics membrane in which the tubes are a sealing fit, the plate being bonded both to the tubes and to the membrane. The seal between the tubes and the membrane prevents the resin being attacked by any fluid in the heat exchanger, for example glycol in the case of a radiator for an internal combustion engine.

The tendency of the resin to shrink in curing ensures a good bond of high mechanical strength with the tubes.

The resin collector plate is preferably "filled", for example with glass spheres or beads for strength.

The membrane may be formed integrally with the walls of the tank, in which case a separate cover member is preferably provided.

Alternatively the membrane may be formed separately from the tank, being a sealing fit therein and being bonded to the resin collector plate. Again, the seal prevents the heat exchanger fluid from attacking the resin.

The tubes are preferably aluminium and the tank is preferably of a plastics material.

The tubes may be round in section, or may be oval or so called flat tubes. In the latter case, in order to prevent shrinkage of the resin from crushing the flat tubes, their ends are preferably pre-bonded, for example soldered, in holes through a transverse metal plate which is embedded, with the tube ends, in the resin layer and acts to absorb the compression on the tubes due to shrinkage of the resin.

Each seal is preferably provided by an inwardly inclined lip which acts resiliently to grip the tube or tank walls.

The tubes may be provided with a secondary heat exchange surface in the form of fins constituted by metal plates through which the tubes pass or by a zigzag or corrugated metal strip between flat tubes. In the latter case a side plate parallel to the tubes is preferably provided at each side of the heat exchanger each plate having its ends bonded into the resin layer at each side in order to allow a zig-zag or corrugated strip to be inserted between it and the outermost flat tube.

Internal baffles may be formed integrally with the membrane or with the tank and in the latter case may extend through the membrane to bond with the resin collector plate.

Embodiments of the invention will now be described by way of example with reference to the accompanying drawings in which.

Figure 1:
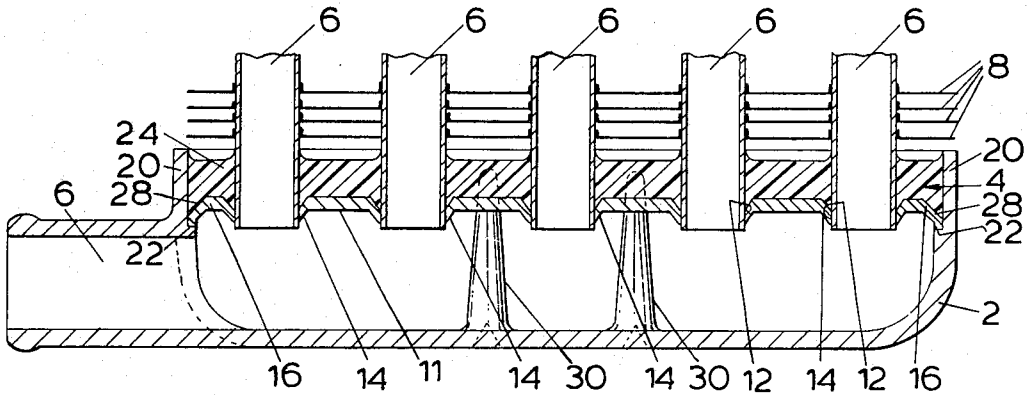
FIG. 1 is a cross-section through a header tank of a heat exchanger in accordance with the invention.

The heat exchanger illustrated in FIG. 1 has a pair of header tanks 2 only one of which is shown. The tanks have opposed collector plates 4 between which a matrix of circular section tubes 6 extend communicating with the header tanks to allow heat exchanger fluid to flow through the tubes from one tank to the other.

The tubes 6 are metallic, preferably aluminium, to facilitate heat exchange between fluid flowing therein and fluid such as air flowing thereacross. The heat exchange is further facilitated by an array of fins 8 comprising metal sheets, the tubes being a tight fit in suitably spaced holes in the sheets.

The tank 2 is of plastics material and has an inlet/outlet 10 for passage of heat exchanger fluid.

The collector plate 4 is formed of a layer of epoxy resin which is filled with glass spheres or beads and which is cast on a stiffly resilient plastics membrane 11 with holes 12 to accommodate the ends of the tubes 6. An inwardly inclined lip 14 is formed round the edge of each hole 12 and is so dimensioned as to rsiliently grip the end of the respective tube 6 so as to form a seal.

The edge of the membrane 11 is also formed with an inwardly inclined lip 16 which is a resilient force fit against the walls 20 of the tank and which locates against a shoulder 22.

The dimples 28 in the outer surface of the membrane 11 left by the inclined lips around the tubes and around the edge of the membrane expose an additional area of the tubes and the tank walls to the resin ensuring a good bond. The resin shrinks on curing to provide a bond of high mechanical strength with the tubes.

The tank illustrated in FIG. 1 is formed with internal baffles 30 the ends of which pass through the membrane 11 and are embedded in the resin layer 24. This construction is particularly useful when the header tank is long, as the baffles lend strength to the construction.

We have found that a suitable glass filled resin can be formulated as follows:

100 grams of CIBA MY750 are heated to 80° C, 27 grams of CIBA HT972 (D.D.M.) are heated to 100° C and the two are mixed together quickly. 300 grams of CPO2 BALLOTIN (Epoxy compatible glass beads — 50 micron) is added and stirred in briskly. The mixture is degassed for 5 minutes and applied to the end plate which is at 80° C. The system is then cured for 1 hr. at 100° C followed by 3 hrs. at 140° C and allowed to cool slowly.

The glass sphere filling mechanically strengthens the resin and reduces the effect of shrinkage. The spheres tend to sink onto the membrane which is desirable as this is where the reinforcement is most needed. Other filling materials such as glass fibre could alternatively be used.

The tank can be made of any sufficiently rigid plastics material which is stable e.g. will not melt at the resin curing temperature and which can be bonded thereby. Dough moulding compounds, nylon, noryl, epoxy resin compounds are examples. Suitably treated metals may also be used such as resin coated steel, chromic acid etched or anodised aluminium pressings or die castings etc.

The membrane can be any stiffly resilient plastics material which is stable and which will not melt at the resin curing temperature. It must be capable of forming a resilient seal with the tubes when force fitted and of being force fitted to the tank.

Figure 2:
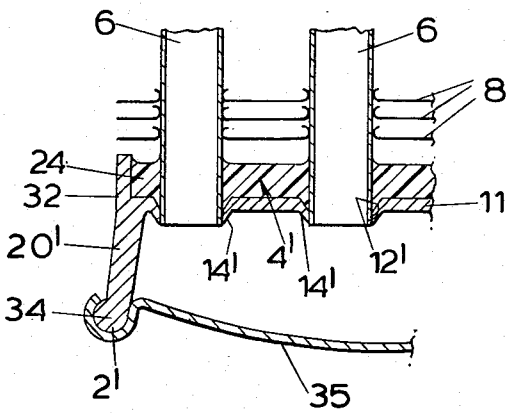
FIG. 2 is a cross-section through a portion of a header tank of a modified heat exchanger.

A modified heat exchanger is illustrated in FIG. 2 and it will be seen that the membrane 11' is formed integrally with the walls 20' of the tank 2'. A lip 32 extends around the edge of the collector plate to contain the resin before it has cured. The 'top' or 'bottom' 35 of the tank is separately formed in this case in metal and at its edges is rolled over a rib 34 on the outer edges of the walls 20, to form a seal.

Figure 3:
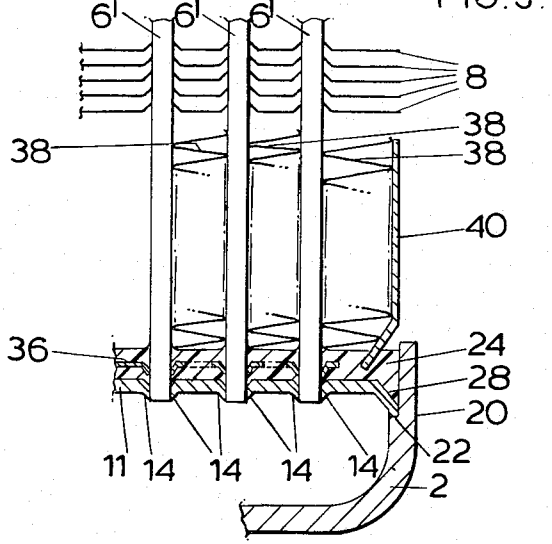
FIG. 3 is a cross-section through a part of a header tank of another heat exchanger in accordance with the invention.
Figure 4:
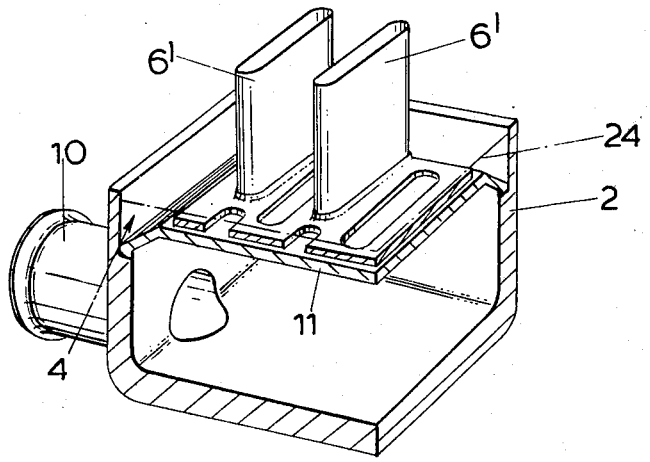
FIG. 4 is a perspective scrap view, part in section, of a portion of the header tank of the heat exchanger of FIG. 3.
Figure 5:
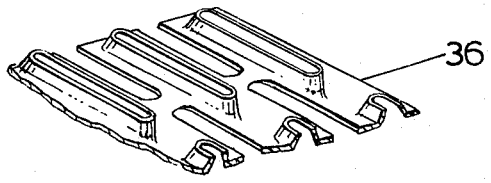
FIG. 5 is a perspective view of a detail of FIG. 3.
Figure 6:
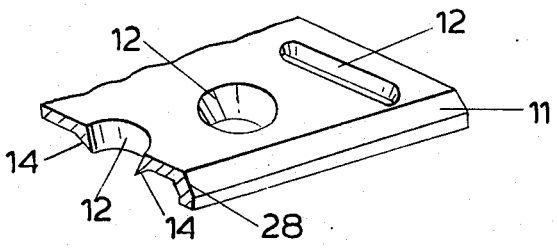
FIG. 6 is a perspective view of another detail of FIG. 3.

The construction of the heat exchanger illustrated in FIGS. 3 to 6 is similar to that of FIG. 1, however the tubes 6' are flat as illustrated in FIG. 4. The flat tubes 6' are susceptible to crushing due to the compressive force of the resin as it shrinks on curing. In order to combat this the tube ends are soldered into corresponding holes in a plate 36 which is embedded in the resin collector plate 4 as seen in FIG. 3 and which absorbs the compressive forces.

As indicated in FIG. 3 the flat tubes 6' may be fitted with fins 8 or may have zig-zag or corrugated metal strips 38 sandwiched therebetween. In order that the outermost tubes 6', at each side, may have a strip 38, a side plate 40 may be fitted to retain the strip. The side plate 40 is embedded at its ends in the resin collector plate as illustrated.

I claim:

1. A heat exchanger comprising a header tank that defines a fluid chamber, said header tank having a plastic membrane wall that forms a portion of said tank's wall, an annular wall extending outwardly from said header tank's wall and surrounding at least a portion of said membrane wall, said membrane and annular walls thereby defining a casting mold on the exterior surface of said header tank, a plurality of tubes connected in fluid transfer relation with that portion of said header tank's membrane wall surrounded by said outwardly extending annular wall, structure fixing each of said tubes and said membrane wall in mechanical resilient grip relation one to the other, said structure providing a fluid tight seal therebetween, and a resin compound cast onto the exterior surface of said header tank in that area defined by said annular wall to form a resin layer of substantial thickness, the resin compound being such as to provide a bond of strength with said tubes and with said membrane wall, said membrane wall and said resin layer thereby combining to form a rigid collector plate for said heat exchanger.

2. A heat exchanger as claimed in claim 1 in which said resin layer is formed of an epoxy resin filled with at least one of glass spheres, beads and fibers.

3. A heat exchanger as claimed in claim 1 in which each tube and membrane wall connection is defined by a hole in the membrane wall through which the end of that tube passes, and an inclined lip extending inwardly from said membrane wall and being sized to resiliently grip that tube in a sealing relation.

4. A heat exchanger as claimed in claim 1 in which said tank is provided with at least one internal baffle formed integral with that tank wall opposite said membrane wall, said baffle being sized to extend through said membrane wall into said cast resin layer.

5. A heat exchanger as claimed in claim 1 in which said membrane wall and said header tank's wall are formed integrally one with the other from a plastic material.

6. A heat exchanger as claimed in claim 1 in which the ends of at least a portion of said tubes are bonded in holes in a rigid plate, said rigid plate being imbedded in said resin layer.

7. A heat exchanger comprising a header tank that defines a fluid chamber, said header tank having a membrane wall that forms a portion of said tank's wall, an annular wall extending outwardly from said header tank's wall and surrounding at least a portion of said membrane wall, said membrane and annular walls thereby defining a casting mold on the exterior surface of said header tank, a plurality of tubes connected in fluid transfer relation with that portion of said header tank's membrane wall surrounded by said outwardly extending annular wall, said tubes and membrane wall being sealingly fixed one to the other in a mechanical resilient grip relation, each tube and membrane wall connection being defined by a hole in the membrane wall through which the end of that tube passes, and an inclined lip extending inwardly from said membrane wall and being sized to resiliently grip that tube in a sealing relation, and a resin compound cast onto the exterior surface of said header tank in that area defined by said annular wall to form a resin layer of substantial thickness, the resin compound being such as to provide a bond of strength with said tubes and with said membrane wall, said membrane wall and said resin layer thereby combining to form a rigid collector plate for said heat exchanger.

8. A heat exchanger as claimed in claim 7 in which said resin layer is formed of an epoxy resin filled with at least one of glass spheres, beads and fibers.

9. A heat exchanger as claimed in claim 7 in which said tank is provided with at least one internal baffle formed integral with that tank wall opposite said membrane wall, said baffle being sized to extend through said membrane wall into said cast resin layer.

10. A heat exchanger as claimed in claim 7 in which said membrane wall and said header tank's wall are formed integrally one with the other from a plastic material.

11. A heat exchanger as claimed in claim 7 in which the ends of at least a portion of said tubes are mounted in holes in a rigid plate, said rigid plate being imbedded in said resin layer.

* * * * *